US007331577B2

(12) United States Patent
Park

(10) Patent No.: US 7,331,577 B2
(45) Date of Patent: Feb. 19, 2008

(54) APPARATUS TO GUIDE PRINTING SHEET FOR USE IN AN IMAGE FORMING DEVICE

(75) Inventor: Jin-ho Park, Youngin (KR)

(73) Assignee: Samsung Electronics Co., Ltd., Suwon-Si (KR)

( * ) Notice: Subject to any disclaimer, the term of this patent is extended or adjusted under 35 U.S.C. 154(b) by 176 days.

(21) Appl. No.: 10/408,112

(22) Filed: Apr. 8, 2003

(65) Prior Publication Data

US 2003/0193130 A1 Oct. 16, 2003

(30) Foreign Application Priority Data

Apr. 11, 2002 (KR) ..... 2002-19692

(51) Int. Cl.
*B65H 1/00* (2006.01)

(52) U.S. Cl. ..... 271/171; 271/145

(58) Field of Classification Search ..... 271/145, 271/171

See application file for complete search history.

(56) References Cited

U.S. PATENT DOCUMENTS

| | | | |
|---|---|---|---|
| 5,927,702 A | 7/1999 | Ishii et al. | |
| 6,254,086 B1 | 7/2001 | Sunou et al. | |
| 6,659,451 B2 * | 12/2003 | Kim | 271/145 |

FOREIGN PATENT DOCUMENTS

| | | |
|---|---|---|
| DE | 1270049 | 6/1968 |
| JP | 01-209227 | 8/1989 |
| JP | 6-115716 | 4/1994 |
| JP | 6-271094 | 9/1994 |
| JP | 7-285681 | 10/1995 |
| JP | 8-198458 | 8/1996 |
| JP | 10/203654 | 4/1998 |
| JP | 10-203654 | 8/1998 |
| JP | 10203654 A * | 8/1998 |
| JP | 10-329951 | 12/1998 |

* cited by examiner

*Primary Examiner*—Patrick Mackey
*Assistant Examiner*—Kaitlin S Joerger
(74) *Attorney, Agent, or Firm*—Staas & Halsey LLP

(57) ABSTRACT

An apparatus to guide a printing sheet in an office machine such as a printer. The apparatus includes a sheet guide to guide and set the printing sheet placed in a plate which forms a printing sheet tray or cassette, a slide-fixing part to movably dispose the sheet guide on the plate, a locking part to lock the sheet guide to the plate after the sheet is guided and set by the sheet guide, and a pivot prevention part having a pair of racks formed parallel to each other on the plate, and a pair of pinions rotatably disposed in the sheet guide to engage the respective ones of racks. The pivot prevention part disperses a force imparted to the sheet guide, thereby enabling the sheet guide to move parallel with an edge of the sheet.

15 Claims, 6 Drawing Sheets

APPARATUS TO GUIDE PRINTING SHEET FOR USE IN AN IMAGE FORMING DEVICE

CROSS-REFERENCE TO RELATED APPLICATIONS

This application claims the benefit of Korean Application No. 2002-19692, filed Apr. 11, 2002, in the Korean Intellectual Property Office, the disclosure of which is incorporated herein by reference.

BACKGROUND OF THE INVENTION

1. Field of the Invention

The present invention relates to an automatic sheet feeder adapted for use in an image forming device, such as a printer, a copier, fax machines, and a so-called multi-function machine that includes print, copy, and fax functions, or the like, and more particularly, to an apparatus to guide a printing sheet in the office machine, to set the printing sheet to be loaded in the automatic sheet feeder according to its width and size, and to prevent the printing sheet from being fed in a skewed or inclined state during a pickup operation.

2. Description of the Related Art

Generally, an office machine, for example, a printer, a copier, a facsimile machine, or the like, includes, inter alia, an automatic sheet feeder having a printing sheet cassette or a tray containing a large number of sheets, a pickup roller assembly to pick up the uppermost sheet of the sheets contained in the printing sheet tray to be fed into the printer, a printing component for printing given images or letters on the printing sheet fed by the automatic sheet feeder, and a discharging unit for discharging the printing sheet printed by the printing component from the printer.

Among these components of the office machine, the automatic sheet feeder is provided with a sheet guide for guiding the printing sheet in the printing sheet tray during the sheet feeding process so as to prevent the printing sheet from being skewed.

Referring to FIG. 1, there is illustrated a conventional automatic sheet feeder 10 having a sheet guide.

The automatic sheet feeder 10 includes a plate 11 having formed thereon a first latch part 12*a* having a plurality of latches with a given pitch and a guide hole 12*b*. The automatic sheet feeder 10 further includes a sheet-side guide 20 being slidably held to the plate 11 such that the sheet-side guide 20 slides along the guide hole 12*b*. A second latch part 21 (FIG. 2) of the sheet-slide guide 20 has a latch positioned in a serrated engagement with the latches of the first latch part 12*a* in the plate 11. The automatic sheet feeder 10 may also include a pickup roller assembly 30 mounted over the plate 11 to feed the printing sheet set by the sheet-side guide 20.

In order to release the serrated engagement between the first and second latch parts 12*a*, 21 to move the sheet-side guide 20, a latch-releasing handle 23 is formed at a portion of the sheet-side guide 20.

As illustrated in FIG. 3, the sheet-side guide 20 supporting an edge of the printing sheet is slidably held in the guide hole 12*b* of the plate 11 by a latch guide 13. The latch guide 13 is engaged with a plurality of fixing pieces 22*a*, 22*b* formed as an elastic member on a bottom of the sheet-side guide 20 to be inserted in the guide hole 12*b*, and fastened to a fixing member 22*c* formed on the bottom of the sheet-side guide 20, by a screw 26.

In operation, the serrated engagement between the first latch part 12*a* and the second latch part 21 is disengaged by gripping or pushing the latch-releasing handle 23, and then the sheet-side guide 20 is allowed to slide along the guide hole 12*b* on the plate 11 so that the guide face 24 is set against side edges of the printing sheets in order to accommodate different sizes of the sheets.

When a printing sheet is picked up and fed by the pickup roller assembly 30, the sheet-side guide 20 sets and supports a side edge of the sheet to prevent the printing sheet from being fed in a skewed or twisted state, which may be caused by the pickup friction force generated by the pickup roller assembly 30.

However, in the automatic sheet feeder 10, a gap between the fixing pieces 22*a*, 22*b* of the sheet-side guide 20 and the guide hole 12*b* exists due to fabrication error, tolerance, etc. The rotation-twist force generated by the pickup roller assembly 30 in a pickup operation may cause the sheet-side guide 20 to move as much as the gap, this in turn allows the printing sheet freedom of movement. When the printing sheet is allowed to move, it may still be fed in the skewed state since the side edge of the printing sheet may not conform to the guide face 24 of the sheet-side guide 20. Thus, the printing sheet may not be in the proper alignment or orientation. This may cause a paper jam, or a skewed printing, and thus causing the printing quality to deteriorate.

Moreover, the sheet-side guide 20 itself may become misaligned. This is because of the above mentioned gap and the structure of the sheet-side guide 20 where the guide face 24 extends along a length, and is supported by a single point along the guide hole 12*b*. When a sheet, which extends along only a portion of the guide face 24, is being fed, the pickup friction force imparted on the printing sheet by the pickup roller assembly 30 is exerted mostly on the portion of the guide face 24, with which the edge of the makes contacts with the guide. The uneven exertion of the force subjects the sheet-side guide 20 to a moment of rotation, and causes the sheet-side guide 20 to pivot about the single supporting point. This tendency for the sheet-side guide 20 to pivot becomes particularly profound when a small size paper, e.g., an envelope, a post card, or the like, is being fed since the moment of rotation becomes greater. As a result, the sheet-side guide 20 may tilt from the proper alignment, causing the printing sheet to be fed in the skewed state.

In a conventional automatic sheet feeder 10, in order to prevent the undesirable movement of the sheet-side guide 20, an upper surface 25 of the sheet-side guide 20 is made to closely contact a sidewall 15 of a recess 14 formed on the plate 11. Alternately, in another prior attempt to solve the above problem, an additional guide hole (not shown) to support the sheet-side guide 20 is provided to allow the sheet-side guide 20 to be supported along two sliding holes. However, the shortcoming associated with these prior attempts is that the sliding movement of the sheet-side guide 20 generates a surface friction between the upper surface 25 of the sheet-side guide 20 and the sidewall 15 and/or between the additional fixing pieces and the additional guide hole, making it difficult to slide the sheet-side guide 20 when adjusting the same for different sizes of the sheets. There is also an attempt to remove the surface friction by applying lubricating oil, but the lubricating oil alone cannot completely remove the frictional resistance. The lubricating oil may contaminate the printing sheet or other components of the office machine, which may be further exacerbated by the collection dust by the lubricating oil.

SUMMARY OF THE INVENTION

Accordingly, it is an aspect of the present invention to provide an improved apparatus to guide a printing sheet for use in an office machine, having a rotation-twist prevention part to reliably set and guide the printing sheet loaded in the automatic sheet feeder, so that the printing sheet is not influenced by the rotation-twist force, and to prevent the printing sheet from being fed in a skewed or inclined state during a pickup operation. The apparatus also allows for easy handling of the printing sheets.

Additional aspects and advantages of the invention will be set forth in part in the description which follows and, in part, will be obvious from the description, or may be learned by practice of the invention.

The foregoing and/or other aspects may be achieved by providing an apparatus to use in a sheet feeder of an image forming apparatus having a plate that forms a part of a sheet holding tray for holding one or more printing sheets, including a sheet guide movably mounted to said plate, said sheet guide being configured to slide across said plate along a first direction, and including a guide face member extending along a second direction perpendicular to said first direction; and a pivot prevention part configured to prevent said guide face member from pivoting about a point on said guide face member by transferring a force imparted on a first location along said guide face member to a second location an opposite side of said point from said first location along said guide face member such that respective amounts of movements of said first location and said second location in said first direction is substantially equal.

The foregoing and/or other aspects may also be achieved by providing a recording medium holder, including a plate to hold said recording medium; a guide, slidably coupled to said plate, said guide being configured to oppose and contact an edge of said recording medium; and a force distributor to distribute a force imparted to said guide, including a plurality of racks formed in a parallel spaced-apart relation to each other on said plate; and a plurality of pinions rotatably coupled to said guide, each of said plurality of pinions being located in corresponding relationship with a respective associated one of said plurality of racks, and being configured to rotate in said respective associated one of said plurality of racks.

The foregoing and/or other aspects may also be achieved by providing an image forming apparatus including a recording unit configured to receive a recording medium, and to form an image thereon; a discharge unit configured to remove said recording medium from said recording unit after said image is formed; and a recording medium holder, including a plate to hold said recording medium; a guide, slidably coupled to said plate, said guide being configured to oppose and contact an edge of said recording medium; and a force distributor to distribute a force imparted to said guide, including a plurality of racks formed in a parallel spaced-apart relation to each other on said plate; and a plurality of pinions rotatably coupled to said guide, each of said plurality of pinions being located in corresponding relationship with a respective associated one of said plurality of racks, and being configured to rotate in said respective associated one of said plurality of racks.

BRIEF DESCRIPTION OF THE DRAWINGS

These and/or other aspects and advantages of the invention will become apparent and more readily appreciated from the following description of the preferred embodiments, taken in conjunction with the accompanying drawings of which.

DETAILED DESCRIPTION OF THE PREFERRED EMBODIMENT

Figure 1:
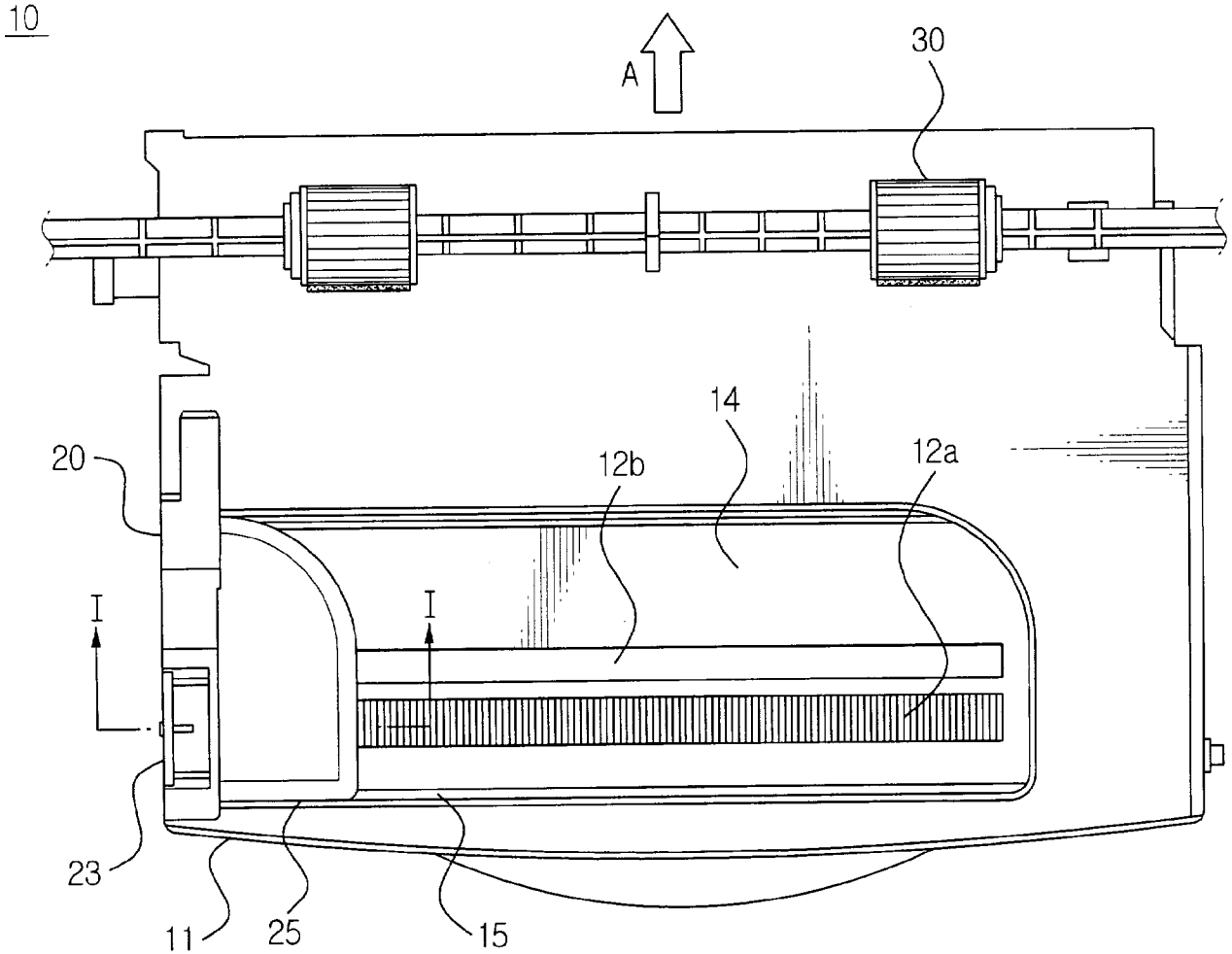
FIG. 1 (PRIOR ART)
FIG. 1 is a top plan view of an automatic sheet feeder to which a conventional apparatus to guide a printing sheet is applied.
Figure 2:
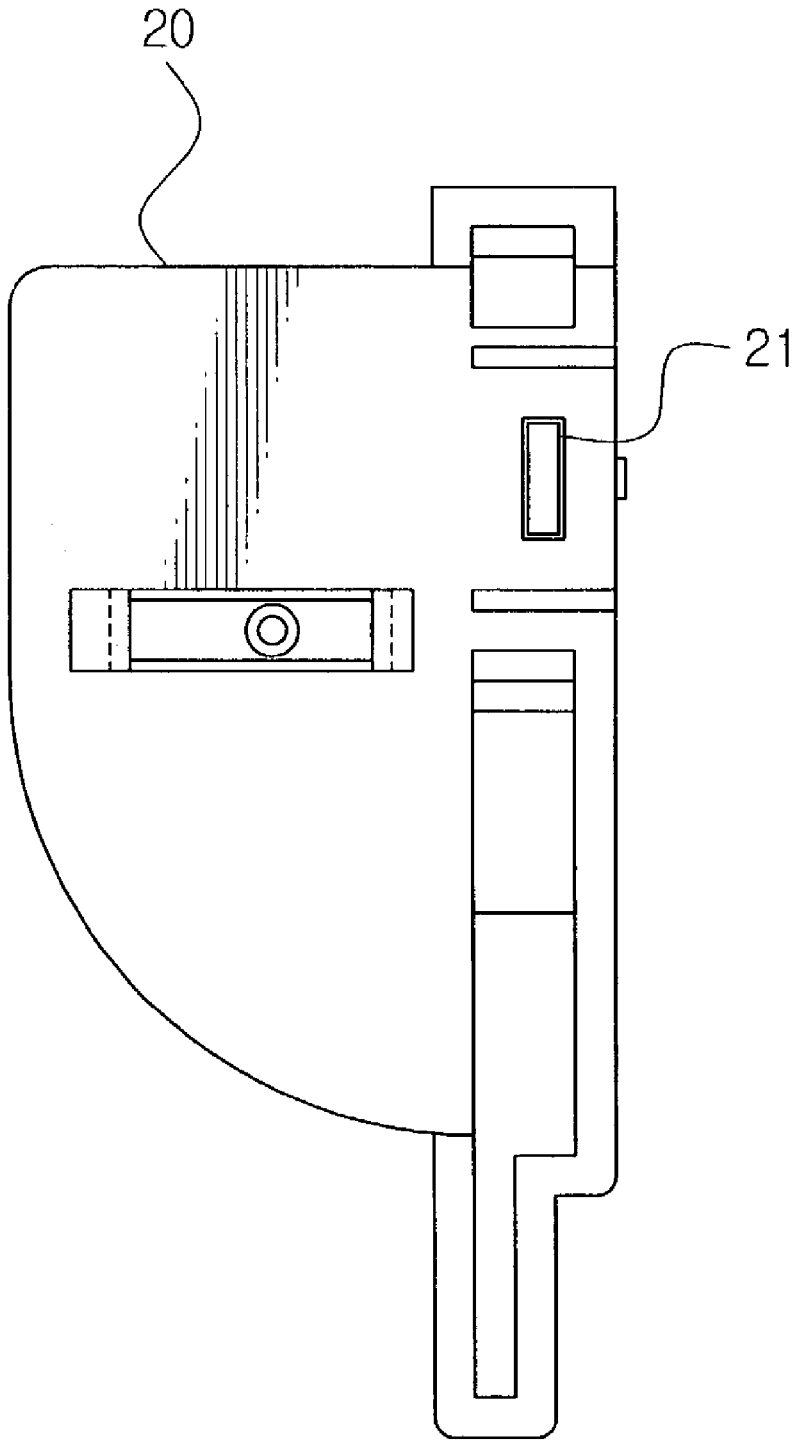
FIG.2 (PRIOR ART)
FIG. 2 is a bottom view of a sheet-side guide of the conventional apparatus shown in FIG. 1.
Figure 3:
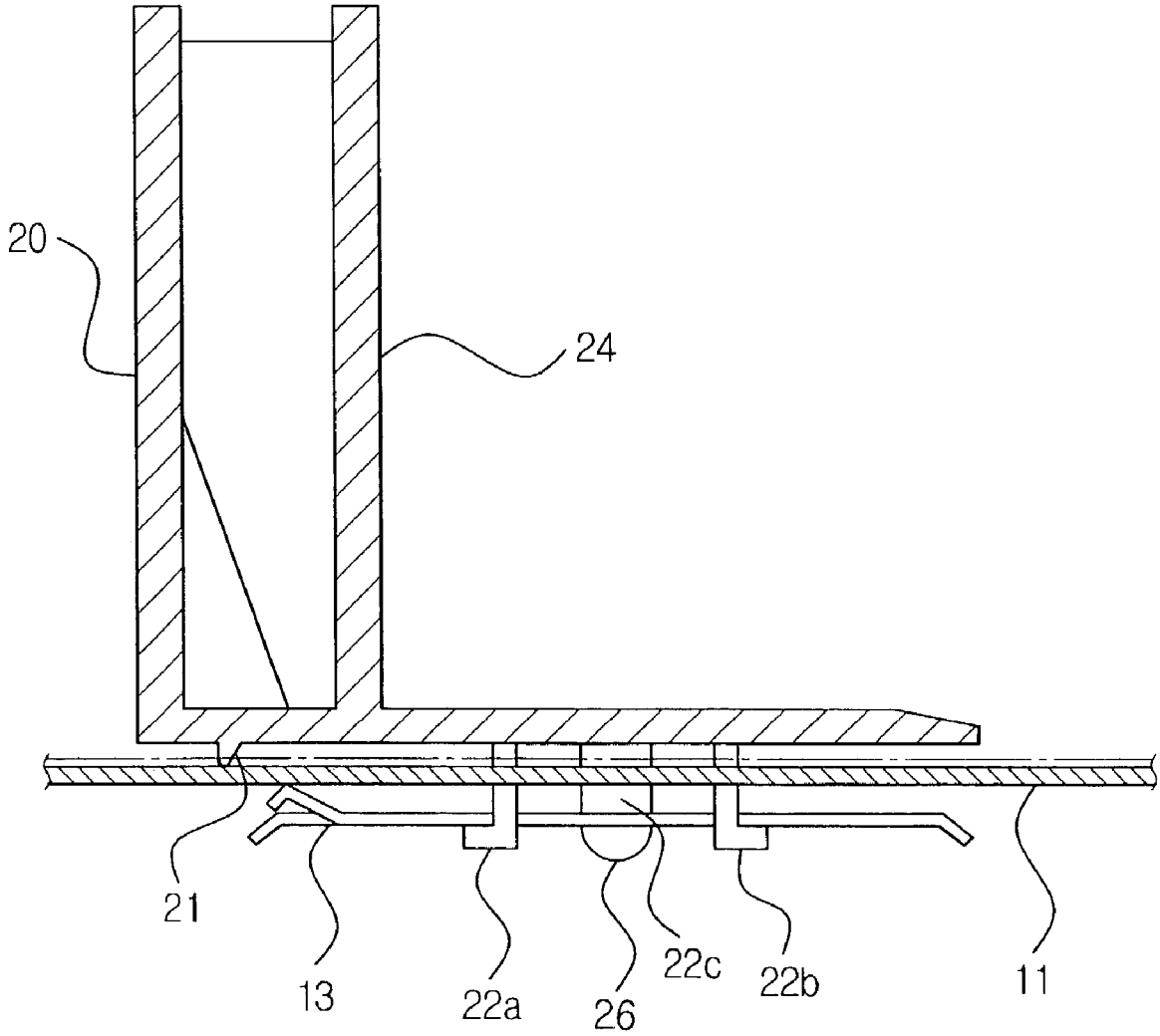
FIG.3 (PRIOR ART)
FIG. 3 is a cross-sectional view of a sheet-side guide of the conventional apparatus taken along line I-I of FIG. 1.

Reference will now be made in detail to the present preferred embodiment of the present invention, an example of which is illustrated in the accompanying drawings, wherein like reference numerals refer to like elements throughout.

Figure 4:
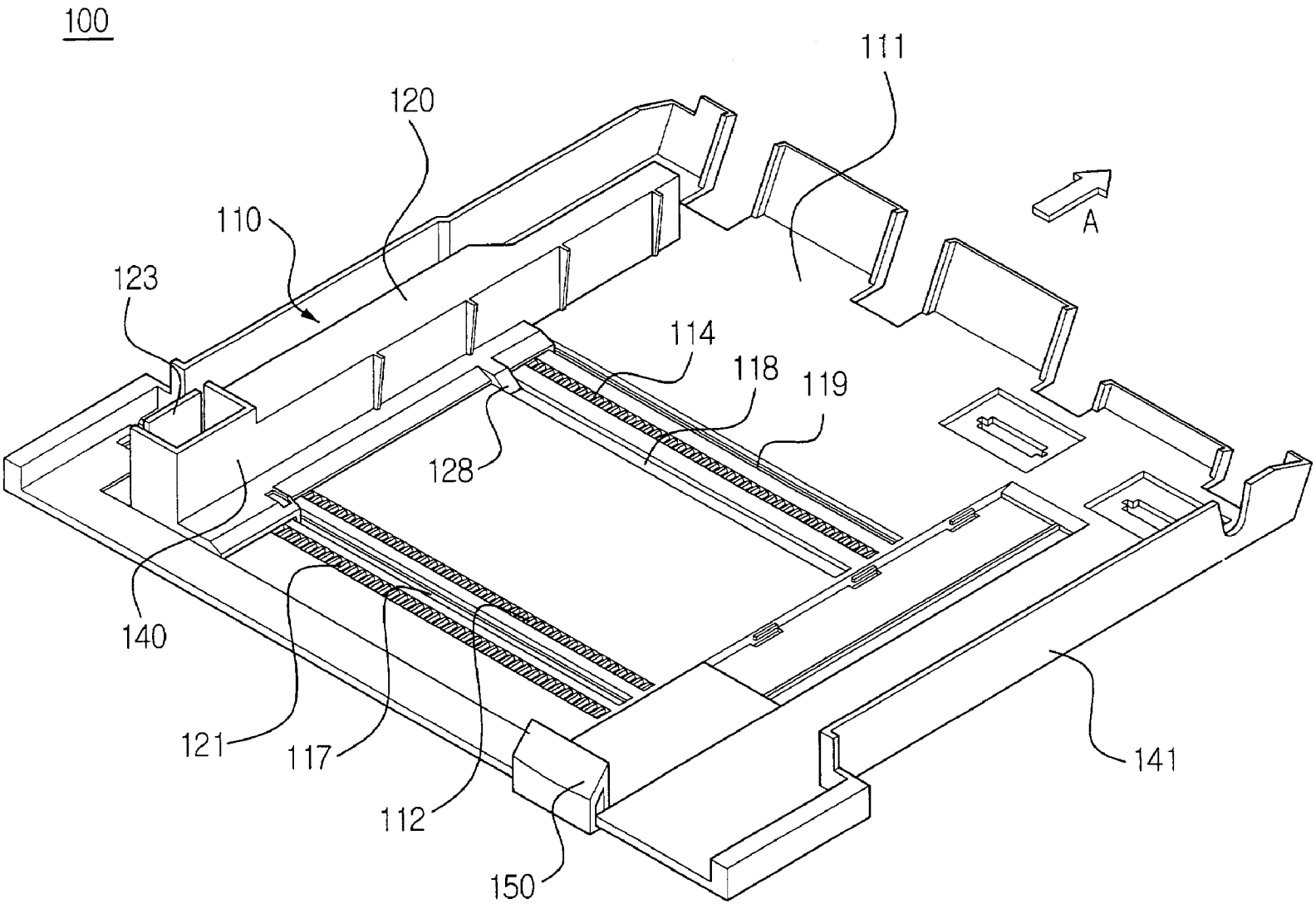
FIG. 4 is a perspective view of an automatic sheet feeder to which an apparatus to guide a printing sheet in accordance with an embodiment of the present invention is implemented.

Referring now to FIG. 4, there is illustrated an automatic sheet feeder 100 for use in an office machine, such as a printer, in which an apparatus to guide a printing sheet in accordance with an embodiment of the present invention is illustrated.

The automatic sheet feeder 100 is provided with a plate 111 to form a printing sheet tray to hold one or more printing sheets, a guide apparatus 110 for guiding the printing sheets of various sizes loaded in the printing sheet tray, and a pickup roller assembly (not shown) mounted over the plate 111 for feeding the printing sheets towards a paper feed direction as indicated by the arrow labeled "A".

Figure 5:
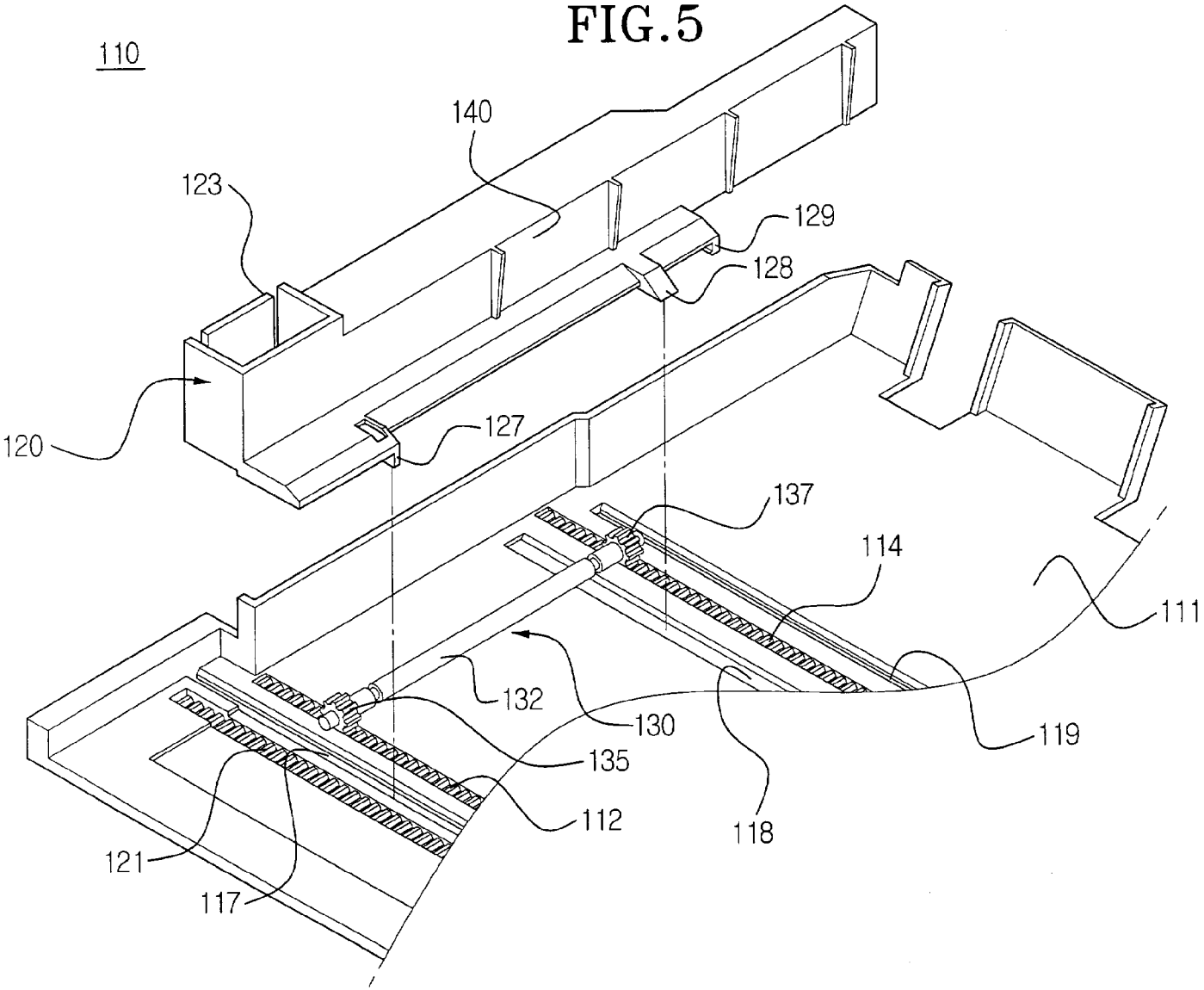
FIG. 5 is an exploded view of the apparatus shown in FIG. 4.
Figure 6:
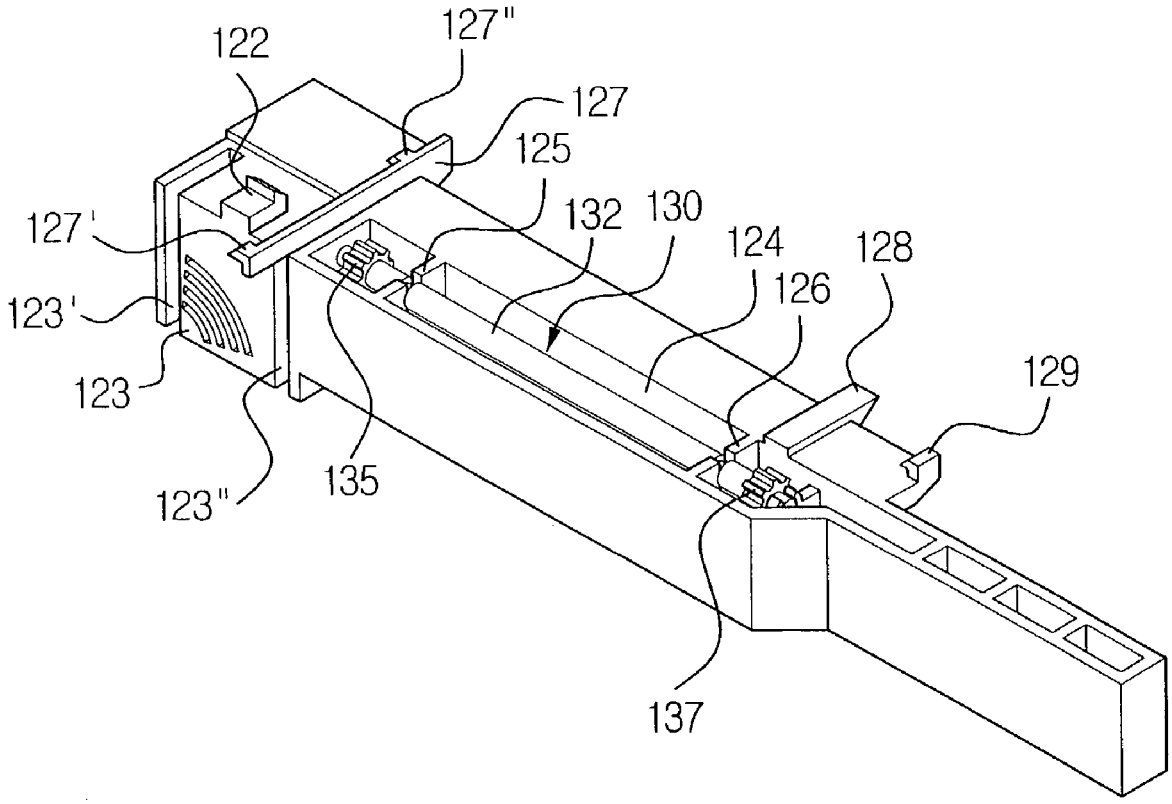
FIG. 6 is a bottom perspective view of a sheet-side guide of the apparatus shown in FIG. 4.

As illustrated in FIG. 5 and FIG. 6, the guide apparatus 110 includes a sheet-side guide 120 to guide a side edge (shown as guiding the left side edge in FIG. 4 and FIG. 5) of the printing sheet placed in the plate 111. The sheet-side guide 120 is configured to slide across the plate 111 in the direction perpendicular to the sheet feeding direction A allowing the adjustment of the position of the sheet-side guide 120 in order to accommodate printing sheets of various sizes. A locking mechanism is also provided to lock the sheet-side guide 120 in place after an adjustment of the sheet-side guide 120.

The sheet-side guide 120 includes a guide face 140 extending along the side of the tray parallel with a sheet feeding direction A to oppose the side edge of the printing sheet.

At the opposite side of the plate 111 (e.g., the right side as shown in FIG. 4), a fixing-guide face 141 is formed to oppose the other side edge, e.g., the right edge in the example shown, of the printing sheet. As shown in FIG. 4, a sheet-end guide 150 also disposed on the plate 111 slides along the direction of the sheet feeding direction A to oppose an end edge (e.g., the trailing end as shown in the example, of the sheet.

In this exemplary embodiment, the sheet-side guide 120 is movably held to the plate 111 by the first and second fins 127, 129 formed at the bottom of the sheet-side guide 120 at respective locations spaced-apart from each other. The fins 127, 129 are received by the first and second receiving holes 117, 119 formed respectively in corresponding locations in the plate 111.

The first fin 127 has two protrusions 127', 127" formed in a spaced-apart relationship to each other to catch against the bottom surface of the plate 1111 so as to slidably fix the sheet-side guide 120 to the plate 111 while allowing the sheet-side guide 120 to move stably. Between the first and second fixing pieces 127, 129, a slide guide 128 is formed to move along the sliding groove 118 in the plate 111 to guide the sliding motion of the sheet-side guide 120.

During operation, the sheet-side guide 120 is locked in place by one of the latches of a first latch portion 121 having a plurality of one way latches formed at a given pitch on the upper portion of the plate 111 and a second latch portion 122 formed at the bottom of the upper portion of the sheet-side guide 120 being engaged with each other. A latch-releasing handle 123 is provided in the sheet-side guide 120 to release the serrated engagement between the first and second latch portions 121, 122, and to allow the sheet-side guide 120 to slide.

At both sides of the latch-releasing handle 123, cut portions 123', 123" are formed. The cut portions 123', 123" allow the latch-releasing handle 123 to move so as to release the serrated engagement between the first and second latch portions 121, 122, when the latch-releasing handle 123 is grasped by a user.

The guide apparatus 110 further includes a pivot prevention part 130. The pivot prevention part 130 functions to disperse a force imparted on one location of the sheet-side guide 120 by the user or by the pickup roller assembly during the pickup operation to at least another location of the sheet-side guide 120, and thereby enables the sheet-side guide 120 to be parallel with a side edge of the printing sheet, even if the force is imparted unevenly along the sheet-side guide 120.

The pivot prevention part 130 includes upper and lower racks 112, 114 formed in a parallel spaced-apart relationship to each other on the plate 111, and upper and lower pinions 135, 137 rotatably disposed to oppose and engage the upper and lower racks 112, 114, respectively, in the bottom recess 124 of the sheet-side guide 120. The pivot prevention part 130 further includes a connecting shaft 132 rotatably held by the upper and lower shaft supports 125, 126 to fixedly couple the upper and lower pinions 135, 137 together.

Here, it should be noted that in the embodiment described above, the upper and lower pinions 135, 137 are explained and illustrated as being coupled together by the connecting shaft 132, but these elements may alternately be fixed in the upper and lower shaft supports 125, 126 by separate shafts, rather than the connecting shaft 132.

Also, the upper and lower pinions 135, 137 are explained and illustrated as being one pinion engaged with the upper and lower racks 112, 114, respectively. However, in an alternative embodiment, these elements can be designed as being two or more pinions engaged with the upper and lower racks 112, 114, respectively.

A force may be imparted on either the upper or lower portions of the sheet-side guide 120, due to the moment rotation generated by the user when he moves the sheet-side guide 120 or by the pickup friction force of the pickup roller assembly when the sheet is fed. The force is distributed along the upper pinion 135 and the upper rack 112, through the connecting shaft 132, to the sheet-side guide 120 itself, as well as to the lower pinion 137 and the lower rack 114. As a result, the sheet-side guide 120 does not pivot out of alignment, and can be maintained parallel with the side edge of the printing sheet to be guided.

As described above, the pivot prevention part 130 is illustrated and explained as being disposed only with respect to the sheet-side guide 120, but the present invention is not limited to this structure. For example, in an alternative embodiment, the pivot prevention parts 130 may be implemented also with respect to the sheet-end guide 150.

Now, the operation of the automatic sheet feeder 100 will be described in detail with reference to FIG. 4 through FIG. 6.

First, to place a number of printing sheets easily in the plate 111, the sheet-side guide 120 may be moved, e.g., to the left a distance greater than the width of the printing sheets by gripping the latch-releasing handle 123 so that the guide face 140 is positioned beyond the width of the printing sheets.

Gripping the latch-releasing handle 123 releases the second latch portion 122 from the first latch portion 121, allowing the sheet-side guide 120 to slide. As the sheet-side guide 120 slides, the first and second fins 127, 129 and the slide guide 128 also move to the left in the first and second receiving holes 117, 119 and the sliding groove 118, respectively.

The upper and lower pinions 135, 137 roll on, and are in engagement with the upper and lower racks 112, 114, respectively, so that the sheet-side guide 120 is moved with a minimum resistance. Moreover, although the force in this example is imparted to the lower portion of the sheet-side guide 120, i.e., at the latch-release handle 123, the force is also distributed to the upper portion of the sheet-side guide 120 by the pivot prevention part 130, and thus the sheet-side remains parallel with the fixing guide face 141.

Once, the sheet-side guide 120 is sufficiently out of the way, the latch-releasing handle 123 is released. The printing sheets are then placed in the plate 111 in such way that the right edges of the printing sheets are aligned against the fixing guide face 141.

After the printing sheets are placed in the plate 111, the latch-releasing handle 123 is again gripped, and the sheet-side guide 120 is moved to the right until the guide face 140 contacts the left edges of the printing sheets. Then, the latch-releasing handle 123 is released to lock the sheet-side guide 120 in place.

Again, the above movement of the sheet-side guide 120 to the right is made with a minimum resistance due to the rolling of the upper and lower pinions 135, 137 on the upper and lower racks 112, 114, respectively, and with the guide face 140 remaining parallel with the fixing guide face 141 due to the pivot prevention part 130.

Next, when a printing process is started, the pickup roller (not shown) is rotated to pick up the topmost one of the printing sheets, and to transport the same to the printer.

At this time, assuming that the printing sheets of a small size having upper ends thereof positioned below the middle portion of the guide face 140 of the sheet-side guide 120 is being transported to the printer by the pickup roller (not shown), the force imparted on the printing sheets by the pickup roller is first obstructed and absorbed by the engagement between the first and second fixing pieces 127, 129 and the first and second piece-receiving holes 117, 119 and between the sliding guide 128 and the sliding groove 118. And then, any unabsorbed force is dispersed to the lower pinion 137 and the lower rack 114 through the lower portion of the sheet-side guide 120, and then to the upper portion of the sheet-side guide 120 and the upper rack 112 through the connecting shaft 132 and the upper pinion 135.

Thus, the sheet-side guide 120 is prevented from being pivoted out of alignment by the force generated by the pickup roller, and properly guides the transported printing sheet so that it too is prevented from being fed in a skewed state.

As is apparent from the foregoing description, it can be appreciated that the apparatus to guide a printing sheet of the embodiment of the present invention can be adjusted with a minimum frictional resistance, and can also reliably guide the printing sheets loaded in the automatic sheet feeder, without being influenced by the rotational or pivotal force. Thus, the printing sheet is not fed in the skewed state during a pickup operation, by having the pivot prevention part including upper and lower racks and pinions to disperse the force. Therefore, the sheet-side guide is always moved parallel with the edges of the sheets to be guided.

Although an embodiment of the present invention has been shown and described, it will be appreciated by those skilled in the art that changes may be made in this embodiment without departing from the principles and spirit of the invention, the scope of which is defined in the claims and their equivalents.

What is claimed is:

1. A printing sheet guide for use in a sheet feeder of an image forming apparatus having a plate that forms a part of a sheet holding tray for holding one or more printing sheets, comprising:

a sheet guide movably mounted to said plate, said sheet guide being configured to slide across said plate along a first direction, and including a guide face member extending along a second direction perpendicular to said first direction, the second direction being a feeding direction of the printing sheets; and a pivot prevention part configured to prevent said guide face member from pivoting about a point on said guide face member by transferring a force imparted on a first location along said guide face member to a second location an opposite side of said point from said first location along said guide face member such that respective amounts of movements of said first location and said second location in said first direction is substantially equal, wherein said pivot prevention part comprises:

a plurality of racks formed in a parallel spaced-apart relation to each other on said plate, and a plurality of pinions opposite each other in the second direction rotatably coupled to said sheet guide to rotate relative to said sheet guide, each of said plurality of pinions being located in a corresponding relationship with a respective associated one of said plurality of racks, and being configured to rotate in said respective associated one of said plurality of racks, the pinions remaining directly opposite each other as the pinions rotate relative to said sheet guide.

2. A printing sheet guide for use in a sheet feeder of an image forming apparatus having a plate that forms a part of a sheet holding tray for holding one or more printing sheets, comprising:

a sheet guide movably mounted to said plate, said sheet guide being configured to slide across said plate along a first direction, and including a guide face member extending along a second direction perpendicular to said first direction; and a pivot prevention part configured to prevent said guide face member from pivoting about a point on said guide face member by transferring a force imparted on a first location along said guide face member to a second location an opposite side of said point from said first location along said guide face member such that respective amounts of movements of said first location and said second location in said first direction is substantially equal, wherein said pivot prevention part comprises:

a plurality of racks formed in a parallel spaced-apart relation to each other on said plate, a plurality of pinions rotatably coupled to said sheet guide, each of said plurality of pinions being located in a corresponding relationship with a respective associated one of said plurality of racks, and being configured to rotate in said respective associated one of said plurality of racks, and a connecting shaft coaxially interconnecting the pinions.

3. The printing sheet guide according to claim 1, further comprising:

a slide-fixing part for movably coupling said sheet-side guide to said plate; and a locking part for locking said sheet guide into place at a desired location on said plate.

4. The printing sheet guide according to claim 3, wherein said slide-fixing part comprises:

at least one fixing fin formed on said sheet guide, said at least one fixing fin having formed thereon at least one protrusion; and at least one receiving hole formed on a portion of said plate corresponding to said fixing fin to receive said at least one fixing fin, said at least one protrusion impeding said sheet guide from being detached from said plate.

5. The printing sheet guide according to claim 3, wherein said locking part comprises:

a plurality of first latches formed on said plate;

a second latch formed on said sheet guide to engage with a select one of said plurality of first latches to lock said sheet guide at said desired location; and a latch-releasing handle formed on said sheet guide to release said second latch from said select one of said plurality of first latches to allow said sheet guide to be moved from said desired location.

6. A printing sheet guide for use in a sheet feeder of an image forming apparatus having a plate that forms a part of a sheet holding tray for holding one or more printing sheets, comprising:

a sheet guide movably mounted to said plate, said sheet guide being configured to slide across said plate along a first direction, and including a guide face member extending along a second direction perpendicular to said first direction;

a pivot prevention part configured to prevent said guide face member from pivoting about a point on said guide face member by transferring a force imparted on a first location along said guide face member to a second location an opposite side of said point from said first location along said guide face member such that respective amounts of movements of said first location and said second location in said first direction is substantially equal;

a slide-fixing part for movably coupling said sheet-side guide to said plate; and a locking part for locking said sheet guide into place at a desired location on said plate, wherein said latch-releasing handle comprises:

a handle formed on said sheet guide, said second latch being attached to said handle; and a pair of cutting portions each formed on either side of said handle, said cutting portions allowing said handle to bend to cause said second latch to be disengaged from said select one of said plurality of first latches, wherein said locking part comprises:

a plurality of first latches formed on said plate, a second latch formed on said sheet guide to engage with a select one of said plurality of first latches to lock said sheet guide at said desired location, and a latch-releasing handle formed on said sheet guide to release said second latch from said select one of said plurality of first latches to allow said sheet guide to be moved from said desired location.

7. The printing sheet guide according to claim 1, further comprising:

a sliding groove formed on said plate, said sliding groove extending along said first direction; and a sliding guide formed on said sheet guide, said sliding guide being configured to slide in said sliding groove.

8. A recording medium holder, comprising:

a plate to hold said recording medium;

a guide, slidably coupled to said plate, said guide being configured to oppose and contact an edge of said recording medium; and a force distributor to distribute a force imparted to said guide, comprising:

a plurality of racks formed in a parallel spaced-apart relation to each other on said plate; and a plurality of pinions rotatably and coaxially coupled to each other, each of said plurality of pinions being located in corresponding relationship with a respective associated one of said plurality of racks, and being configured to rotate in said respective associated one of said plurality of racks.

9. A recording medium holder, comprising:

a plate to hold said recording medium;

a guide, slidably coupled to said plate, said guide being configured to oppose and contact an edge of said recording medium; and a force distributor to distribute a force imparted to said guide, comprising:

a plurality of racks formed in a parallel spaced-apart relation to each other on said plate; and a plurality of pinions rotatably coupled to said guide, each of said plurality of pinions being located in corresponding relationship with a respective associated one of said plurality of racks, and being configured to rotate in said respective associated one of said plurality of racks, wherein said force distributor further comprises:

a common shaft to coaxially connect each of said plurality of pinions.

10. The recording medium holder according to claim 8, further comprising:

a plurality of shaft supports formed on said guide;

a plurality of shafts independent from each other, each of said plurality of shafts being disposed in a respective corresponding one of said plurality of shaft supports, and being fixedly coupled to a respective one of said plurality of pinions.

11. An image forming apparatus comprising:

a recording unit configured to receive a recording medium, and to form an image thereon;

a discharge unit configured to remove said recording medium from said recording unit after said image is formed; and a recording medium holder, comprising:

a plate to hold said recording medium;

a guide, slidably coupled to said plate, said guide being configured to oppose and contact an edge of said recording medium; and a force distributor to distribute a force imparted to said guide, comprising:

a plurality of racks formed in a parallel spaced-apart relation to each other on said plate; and a plurality of pinions rotatably and coaxially coupled to each other, each of said plurality of pinions being located in corresponding relationship with a respective associated one of said plurality of racks, and being configured to rotate in said respective associated one of said plurality of racks.

12. A recording medium holder, comprising:

a plate to hold said recording medium;

a guide, slidably coupled to said plate, said guide being configured to oppose and contact an edge of said recording medium; and a force distributor to distribute a force imparted to said guide, comprising:

a plurality of racks formed in a parallel spaced-apart relation to each other on said plate; and a plurality of pinions rotatably coupled to said guide, each of said plurality of pinions being located in corresponding relationship with a respective associated one of said plurality of racks, and being configured to rotate in said respective associated one of said plurality of racks, wherein said force distributor further comprises:

a common shaft to coaxially connect each of said plurality of pinions.

13. The image forming apparatus according to claim 11, wherein said force distributor further comprises:

a plurality of shaft supports formed on said guide; and a plurality of shafts independent from each other, each of said plurality of shafts being disposed in a respective corresponding one of said plurality of shaft supports, and being fixedly coupled to a respective one of said plurality of pinions.

14. The image forming apparatus according to claim 11, further comprising:

a pick-up assembly configured to pick up said recording medium from said recording medium holder, and to transfer said picked-up recording medium towards said recording unit, wherein said force is a moment of rotation generated by a friction between said pick-up assembly and said recording medium.

15. A printing sheet guide for use in a sheet feeder of an image forming apparatus having a plate that forms a part of a sheet holding tray for holding one or more printing sheets, comprising:

a sheet guide movably mounted to said plate, said sheet guide being configured to slide across said plate along a first direction, and including a guide face member extending along a second direction perpendicular to said first direction; and a pivot prevention part configured to prevent said guide face member from pivoting about a point on said guide face member by transferring a force imparted on a first location along said guide face member to a second location an opposite side of said point from said first location along said guide face member such that respective amounts of movements of said first location and said second location in said first direction is substantially equal, wherein the pivot prevention part directly transfers the force to the opposite side.

* * * * *